United States Patent [19]

Fee et al.

[11] Patent Number: 4,747,354

[45] Date of Patent: May 31, 1988

[54] ENVELOPE DEPOSITORY

[75] Inventors: Kevin A. Fee, Marion; Mark W. Ellis, Cedar Rapids, both of Iowa

[73] Assignee: LeFebure Corporation, Cedar Rapids, Iowa

[21] Appl. No.: 31,762

[22] Filed: Mar. 30, 1987

[51] Int. Cl.[4] ..... G07G 5/00

[52] U.S. Cl. ..... 109/24.1; 109/66

[58] Field of Search ..... 109/24.1, 45, 66, 67, 109/68; 194/344, 350; 232/17, 44, 49; 186/37

[56] References Cited

U.S. PATENT DOCUMENTS

| | | | |
|---|---|---|---|
| 3,836,980 | 9/1974 | Grosswiller | 109/24.1 |
| 4,085,687 | 4/1978 | Beck | 109/24.1 |
| 4,308,804 | 1/1982 | Guibord | 109/24.1 |
| 4,649,832 | 3/1987 | Hain | 109/24.1 |

*Primary Examiner*—Robert L. Wolfe

*Attorney, Agent, or Firm*—Simmons, Perrine, Albright & Ellwood

[57] ABSTRACT

An envelope depository includes an envelope conveyor having return belting traveling in a downward direction at the rear end of the conveyor. To prevent "fishing" and "trapping" of an envelope an envelope receiver is disposed at the rear of the conveyor above the return belting and directs an envelope discharged from the conveyor in an upward direction. The envelope then slides forwardly from the receiver and downwardly from the receiver against the return belting, the belting directing the envelope downwardly into a narrow chute disposed between the rear of the conveyor and the receiver and leading to a collector bin.

6 Claims, 4 Drawing Sheets

ENVELOPE DEPOSITORY

BACKGROUND OF THE INVENTION

The present invention concerns envelope depositories, especially envelope depositories for use in automatic teller machines ("ATM's") but also useful in other applications.

Typically an ATM includes a depository for receiving envelopes enclosing cash, checks or other items a customer wishes to deposit. Usually, the envelope is inserted end first into a horizontal slot in a front wall of the ATM. A conveyor then grasps the envelope and carries it generally rearwardly during which travel a printer stamps one face of the envelope with various indicia including the date, the customer's identification number, the time of day, and the amount of the deposit. The envelope is then discharged from the conveyor and dropped or otherwise directed into a secure collector bin which is later removed and emptied at the bank or the like.

Since the envelope travels more or less horizontally through the conveyor it must change direction in order thereafter to drop into the bin. In some depositories the envelope merely falls off the conveyor directly into the bin; in others an additional mechanism rearward of the conveyor diverts or transports the envelope sideways before dropping it into the bin. In the former types special precautions are necessary to defeat "fishing" of envelopes from the bin or "trapping" of an envelope after it has passed the conveyor but before it drops into the bin. This is typically achieved by a pair of gates disposed forward and rearward of the conveyor, the rearward gate being closed when the forward one is open and vice versa so there is never an unobstructed path between the envlope slot in the front of the ATM and the collector bin. In the latter types the mechanism so changes the path of the envelope between the conveyor and the bin as to defeat any "fishing" or "trapping" effort but does so at the cost of added complexity and additional space requirements within the ATM housing.

SUMMARY OF THE INVENTION

The chief objects of the invention are the provision of an envelope depository which minimizes the space needed for the depository within the ATM housing and at the same time positively defeats envelope "fishing" or "trapping" without added complexity and thus cost.

The objects of the invention are achieved by, in effect, reversing the direction of envelope travel after its departure from the conveyor. This is accomplished by first directing the envelope in an upward direction as it leaves the conveyor and then directing the envelope in a downward direction into a narrow chute leading to the bin. The change of direction is performed by the conveyor in cooperation with a simple, integrally molded envelope receiver and chute disposed just rearwardly of the conveyor. Other features and advantages of the invention will become apparent from the drawings and more detailed description which follow.

DETAILED DESCRIPTION OF THE PREFERRED EMBODIMENT

Figure 1:
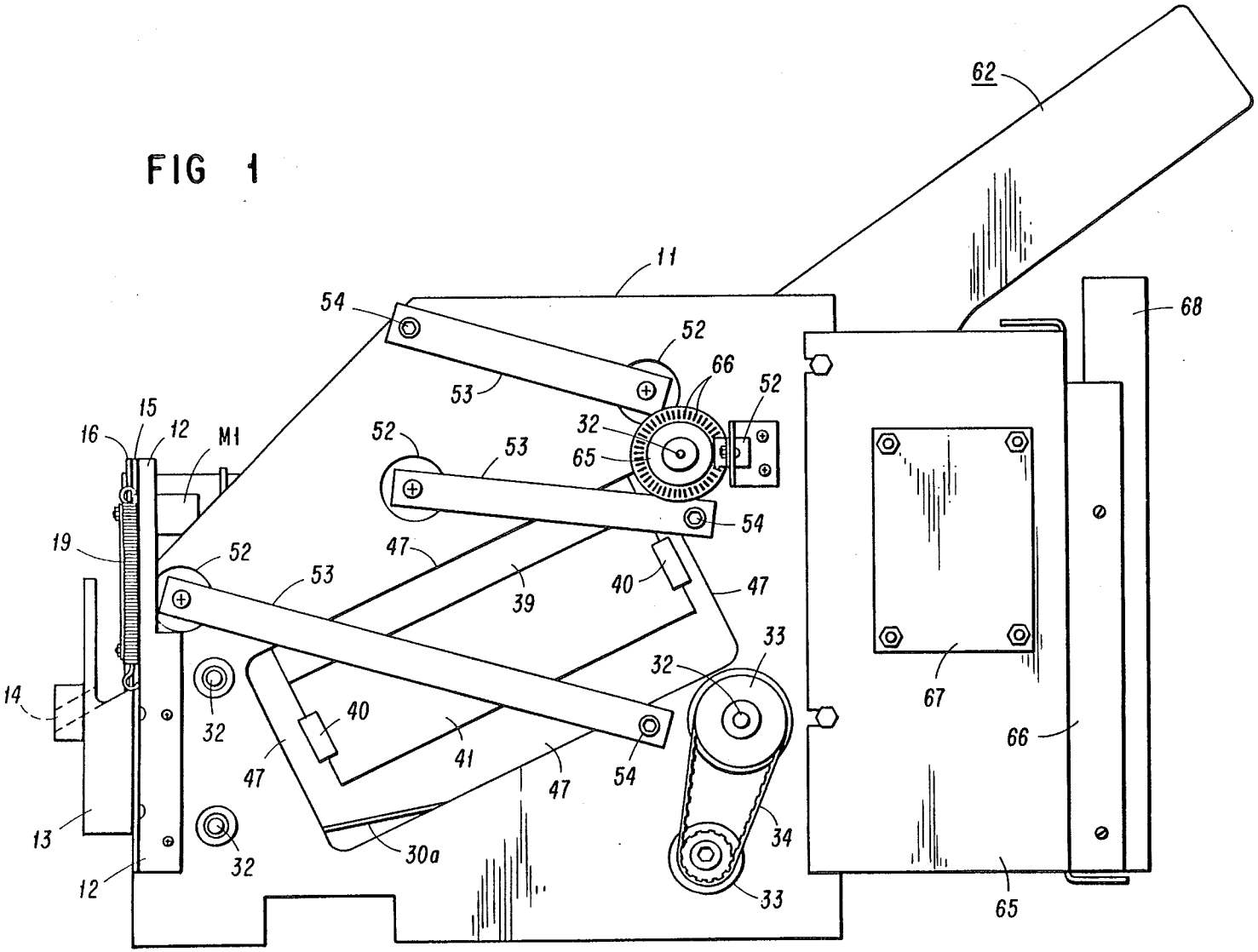
FIG. 1 is an elevational view of one side of an envelope depository according to the invention.
Figure 2:
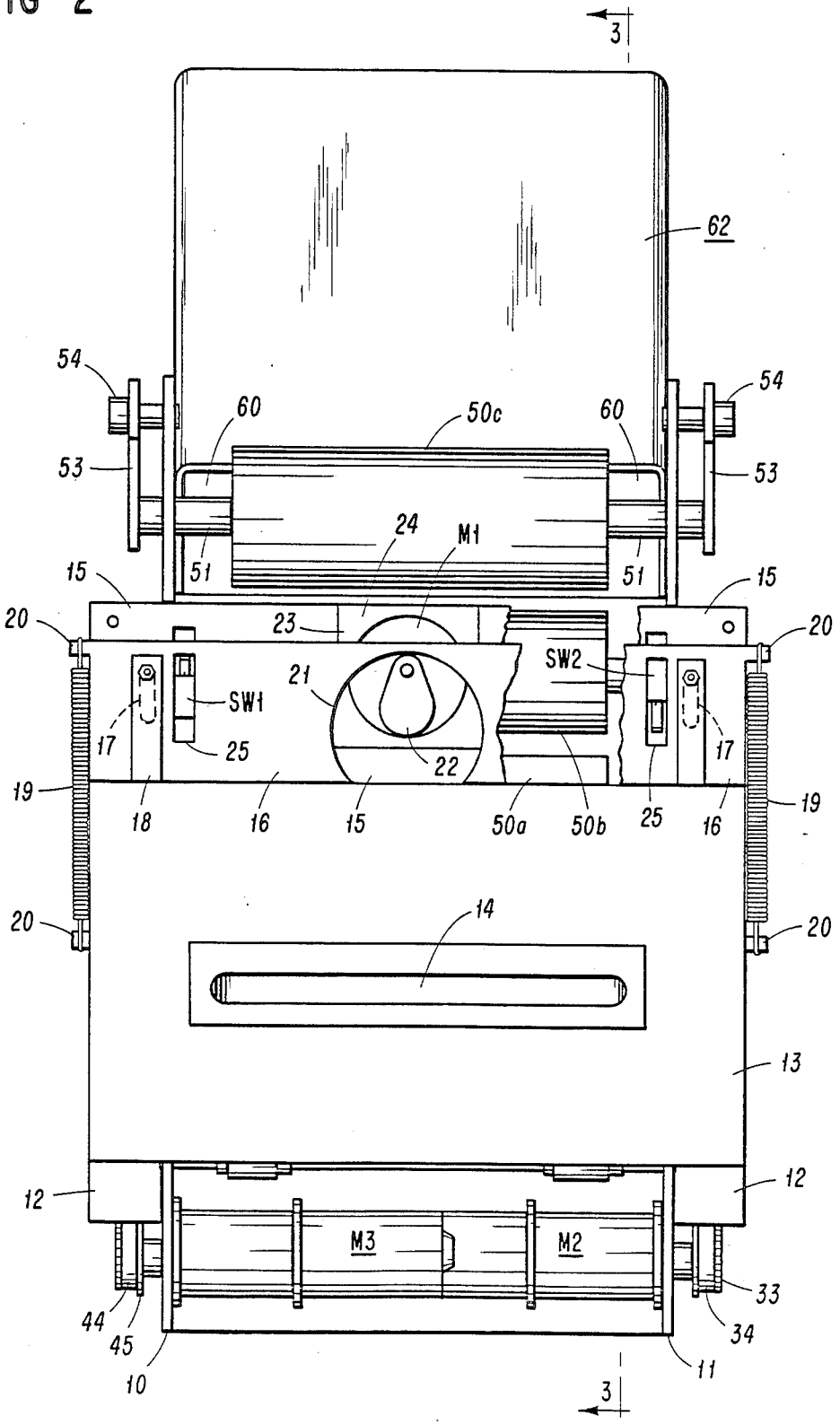
FIG. 2 is a front elevational view of the depository of FIG. 1.
Figure 3:
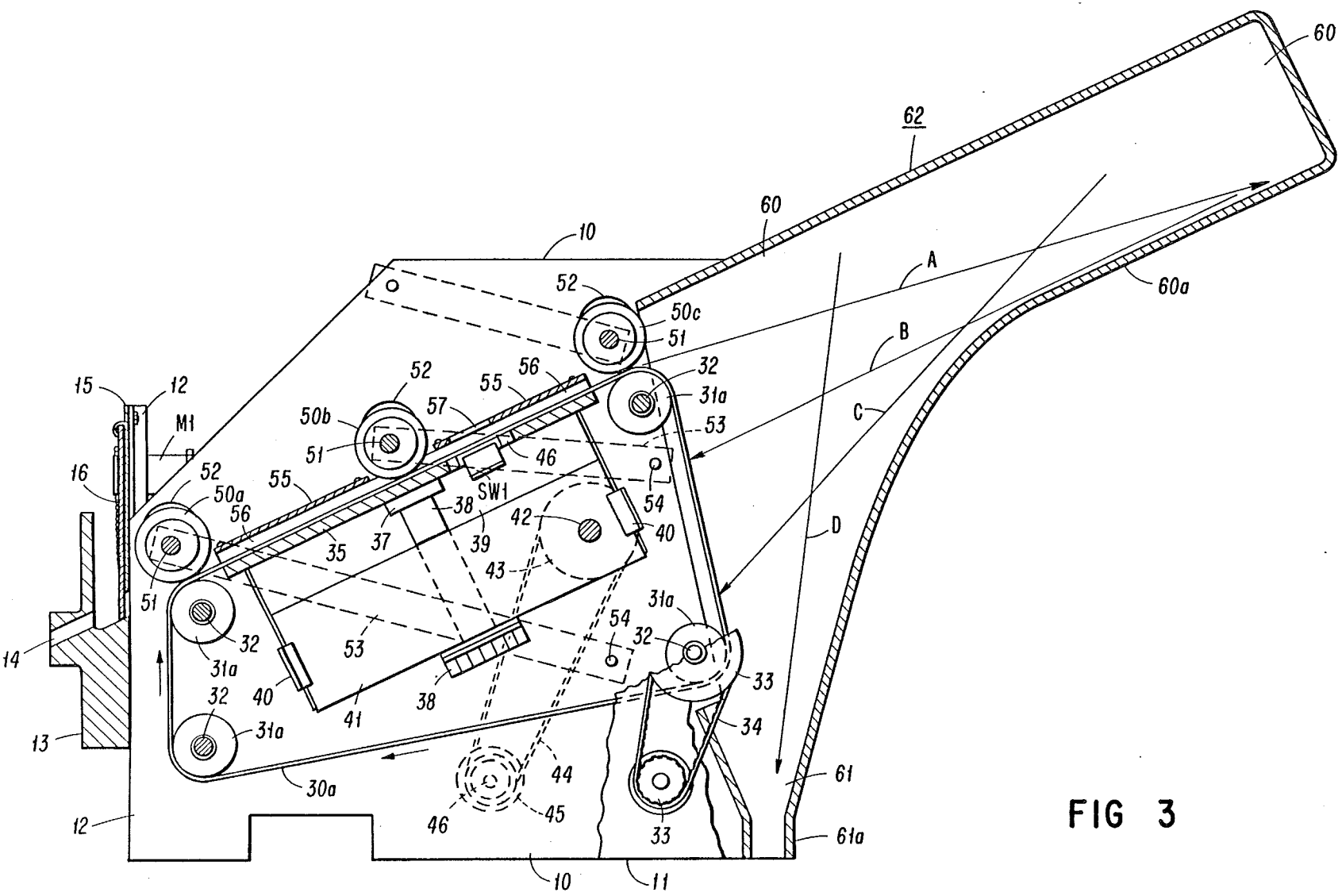
FIG. 3 is a sectional view taken generally along the line 3—3 of FIG. 2.

Referring first to FIGS. 1–3, the envelope depository includes a pair of spaced side plates 10 and 11 to whose forward ends are screwed a pair of vertical angle plates 12. Across the lower ends of the angle plates 12 is fixed a molded, configured nose block 13 having a horizontal, upwardly inclined envelope receiving slot 14. Above the inner face of the nose block 13 a plate 15 is also secured between the angle plates 12 to which is mounted a rectangular gate 16. The gate 16 is vertically slidable for which purpose vertical slots 17 in the gate 16 (the upper two only of which are shown in broken lines in FIG. 2) encompass guide bushings (not shown) secured between the plate 15 and a pair of vertical guide bars 18. The gate 16 in its lower position blocks the inner end of the slot 14 and in its upper position opens the slot 14 for insertion of an envelope. The gate 16 is biased closed by a pair of extensible coil springs 19 secured between lateral tangs 20 at the bottom of the plate 15 and at the top of the gate 16. The upper portion of the gate 16 intermediate its ends is circularly apertured at 21, which aperture is engaged by the heel of a cam 22 extending through a corresponding recess 23 in the top edge of the plate 15. The cam 22 is driven by an electric motor M1 mounted on a bracket 24 behind the plate 15. Hence rotation of the cam 22 by a half revolution of the motor M1 will raise the gate 16 from its closed position shown in FIG. 2 to its open position to admit an envelope through the slot 14. The motor M1 is controlled in part by limit switches SW1 and SW2 mounted to the rear of the plate 15 whose switch arms are received in vertical slots 25 through the plate 15 and gate 16.

Figure 4:
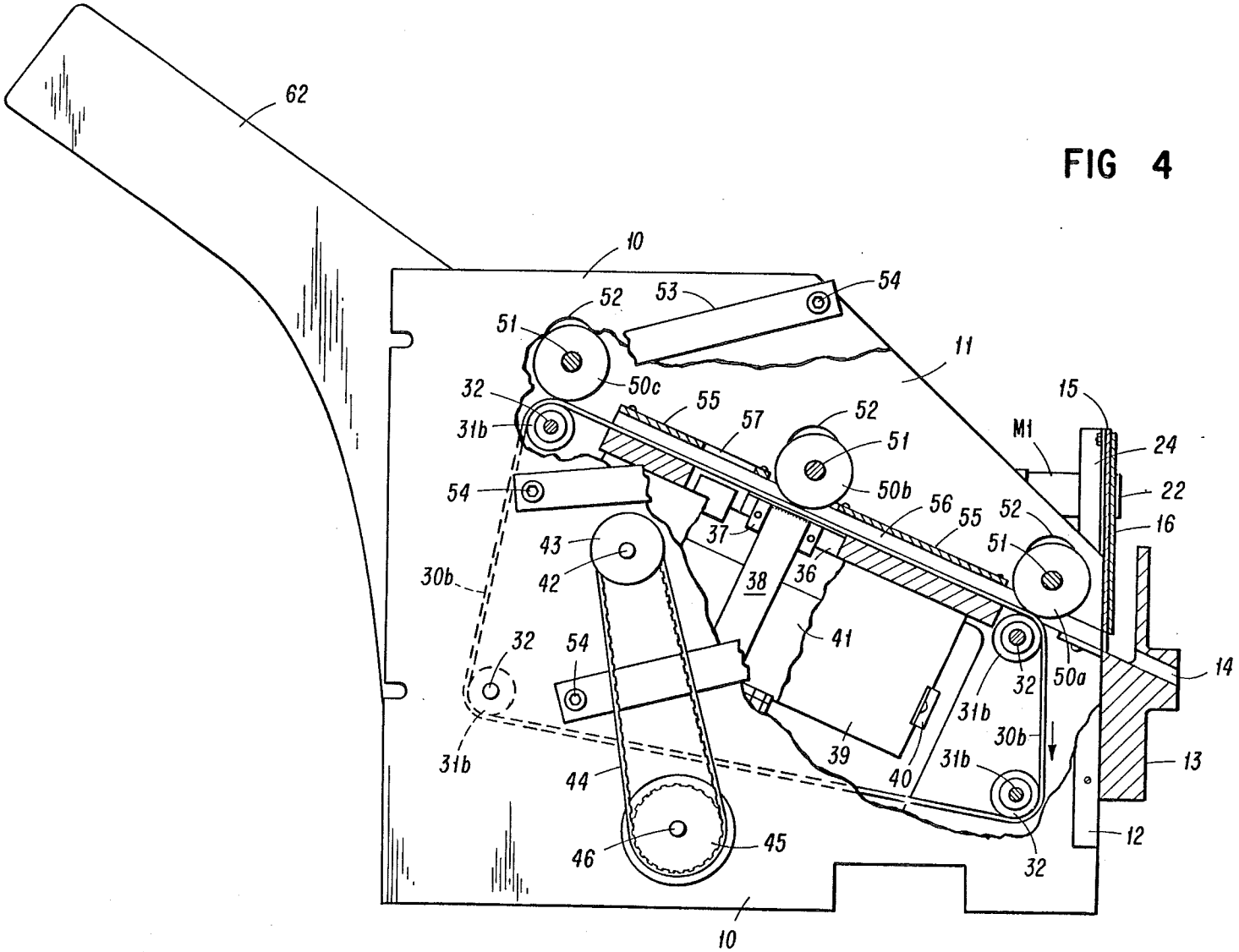
FIG. 4 is an elevational view of the other side of the depository of FIG. 1, certain portions being further broken away.

As the envelope passes rearwardly through the slot 14 it engages an envelope conveyor in the form of a pair of flat, laterally spaced endless belts **30*a* and 30*b* (see FIGS. 3 and 4) having frictional surfaces. The belts 30 are trained over two sets of laterally spaced, crowned pulleys 31a and 31b of four each secured to shafts 32 journaled in turn in the side plates 10 and 11. The upper pulleys 31 are disposed so that the upper flights of the belts 30 form an upwardly inclined extension of the slot 14. The belts 30 are driven in the direction indicated by arrows in the drawings by an electric motor M2 mounted to the side wall 11, its shaft and an extension of the lower rear pulley shaft 32 being fitted with cogwheels 33 and cog belt 34. Between the upper pulleys 31 a rectangular shelf 35 is secured to the side plates 10 and 11 just below and in sliding contact with the lower faces of the belts 30. The shelf 35 is centrally apertured at 36 (see FIG. 4) between the belts 30*a* and 30*b* through which aperture is disposed the printing head 37 of an electromagnetically operated printer 38, the upper face of the head 37 being flush with the upper face of the shelf 35. The printer 38 is secured below the shelf 35 on a bracket 39 fixed in turn to the side plate 10. Clips 40 on the ends of the bracket 39 mount an inked ribbon cartridge 41, the ribbon (not shown) passing over the upper face of the printing head 37 and being fed by a pinion (not shown) engaging the cartridge 41 and fixed to a shaft 42 journaled in the side plate 10 and the bracket 39**.

To the outer end of the shaft 42 is fixed a cogwheel 43 over which is trained a cog belt 44 driven by a cogwheel 45 secured to the shaft 46 of an electric motor M3 (see FIG. 2) mounted to the inner face of the side plate 10. The shelf 35 is further apertured at 46 between the belts 30*a* and 30*b* rearwardly of the printer head 37 in which aperture is mounted a sensor S1 (see FIG. 3) in the form of a photoelectric cell having the emitter and detector integral with each other for purposes to be described. The side plate 10 is also rectangularly apertured at 47 to permit replacement of the ribbon cartridge 41.

Above the shelf 35 are disposed three weighted, horizontal rollers 50*a*, 50*b*, and 50*c*, one each above the forward and rearward upper pulleys 30 and the other above the printing head 37. The rollers 50 are journaled on shafts 51 extending through enlarged apertures 52 in the side plates 10 and 11, the outer ends of the shafts 51 being fixed to the ends of three pairs of arms 53 straddling the side plates 10 and 11 and journaled at their other ends at 54 as shown to the outer faces of the side plates 10 and 11. Hence the rollers 50 ride on the belts 30 and are free to move generally vertically to accommodate envelopes of varying thickness conveyed from the slot 14 by the belts 30. Between the rollers 50 are disposed a pair of cover plates 55 parallel to the shelf 35 and supported above the latter on spacers 56 along the lateral edges of the shelf 35. The rearward cover plate 55 is apertured at 57 above the sensor S1 for reasons to be described.

As the envelope leaves the conveyor it is discharged rearwardly and upwardly into an envelope receiver 60 as shown by the arrow A in FIG. 3 from which it then reverses direction and slides forwardly as shown by the arrow B until its end strikes the descending flights of the belts 30 at the rear of the conveyor as shown by the arrow C. The envelope is thereby directed downwardly as shown by the arrow D into a chute 61 just below the rear of the conveyor and leading to the collector bin (not shown) below. The receiver 60 and chute 61 are an integral plastic molding 62 of the shape shown in the drawings and is secured between the rear ends of the side plates 10 and 11. The rear chute wall 61*a*, it will be observed from FIG. 3, extends upwardly and curves rearwardly to form the receiver floor 60*a*. This curvature between the receiver floor 60*a* and the chute wall 61*a* is important to successful function of the receiver 60. If the radius of curvature is too great the envelope will simply nose down against the floor 60*a* and remain there without being directed up into the receiver 60. If the radius is too small the envelope will not be able to slide back out of the receiver 60 into the chute 61 despite the action of the adjacent flights of the belts 30. Finally, the ends of a U-shaped bracket 65 are attached to the rear of the side plates 10 and 11 and another such bracket 66 to the rear face of the bracket 65, the brackets 65 and 66 serving to mount circuit boards 67 and 68 carrying some of the control circuitry for the electrical components of the depository and the ATM.

Other aspects of the operation of the depository are as follows: Motor M2 is activated to start the conveyor and motor M3 to advance the ribbon when a customer indicates a deposit is to be made. On authorization that a deposit will be accepted from the customer and upon vertification within the ATM that the conveyor is running, motor M1 is activated to open the gate 16 and allow insert of an envelope through the slot 14. Vertification that the conveyor is running is achieved by a sensor S2 (see FIG. 1) in the form of a photoelectric cell having its emitter and detector straddling a timing wheel 65 attached for rotation to the outer end of one of the pulley shafts 32, the timing wheel 65 having a circle of apertures 66 passing between the emitter and detector of the sensor S2. When the envelope reaches the sensor S1 light from the emitter, instead of passing up through the cover plate aperture 57 above the sensor S1, is reflected from the envelope to the detector whereupon the printer 38 is activated. The printer head 37 includes seven small round styli in a row transversely of the direction of envelope travel and electromagnetically urged upward to engage the inked ribbon passing over the head 37 and so print on the lower face of the envelope the indicia commanded by the ATM. The styli are fine enough to print envelopes containing coins, something many printers cannot accommodate resulting in deposits of coin containing envelopes being prohibited in many ATMs. Note that unlike many envelope depositories the envelope does not stop when the printer 38 is activated, that is to say, there is no "print station" where the conveyor halts while the envelope is printed, nor does the printer 38, as in some cases, move relative to the envelope. The rate at which the printer 38 operates obviously must be coordinated with the speed of travel of the envelope and this is also accomplished by the sensor S2 and the timing wheel 65. The printer used in a commercial embodiment of the depository of the invention is manufactured by Eaton Printer Products of Riverton, Wyo. That printer was designed to move relative to a fixed medium to be printed, but in the present application that is reversed, the printer being fixed and the envelope moving instead. Note also that the printer 38 is fixed below the belts 30 so envelopes of varying thickness can be accommodated without a floating mount that would be required were the printer to be disposed above the belts 30 as in other depositories. Once the envelope passes the sensor S1 and drops from the reciever 60 into the bin (not shown) a sensor there, alerted by the passage of the envelope past sensor S1, both activates the motor M1 another half resolution to allow the springs 19 to close the gate 16 and also deactivates the motor M2 to halt the conveyor, whereupon the depository is ready for another cycle of operation.

The gate 16, unlike some in other depositories, performs no security function; it merely blocks the slot 14 to prevent insertion of foreign matter and to keep out the weather. Rather, security against "fishing" and "trapping" is provided solely by the receiver 60 and chute 61 which in cooperation with the belts 30 reverse the direction of an envelope in the manner previously described. Were an envelope in the bin somehow to be grasped and extracted up the chute 61, an almost impossible task in itself even were the envelope somehow to get past the shutter with which the bin is equipped to prevent just that, it could never make the turn onto the rear of the belts 30 at the forward end of the receiver 60 nor be withdrawn over the frictional surfaces of the belts themselves. An attempt to "trap" an envelope above the chute 61 would be thwarted in the same manner. Hence security is assured and accomplished in a simple and economical way unlike present such depositories. Note that the overall depth of the depository is thereby kept to a minimum since an envelope is also directed upwardly rather than merely rearwardly and the chute 61 is narrow in a fore-and-aft direction and disposed immediately to the rear of the conveyor. This is of some importance since there is more space within a typical ATM housing in the vertical than the fore-and-aft direction.

Though the invention has been described in terms of a particular embodiment deemed to be the best mode known of carrying out the invention, it is not limited to that embodiment alone. Instead, the following claims are to be read as encompassing all adaptations and modifications of the invention falling within its spirit and scope.

We claim:

1. In an envelope depository having forward and rearward ends, the forward end including a horizontal slot for receiving an envelope containing matter to be deposited, and envelope conveyor means having forward and rearward ends and disposed rearwardly of the envelope slot effective to convey an envelope introduced into the slot in a rearwardly direction and to discharge same from a rearward end of the conveyor means, the improvement comprising: an envelope receiver having forward and rearward ends, the envelope receiver extending in an upwardly inclined direction from the rearward end of the conveyor means effective to receive therein an envelope discharged from the rearward end of the conveyor means; envelope directing means disposed at the forward end of the envelope receiver and below said rearward end of the conveyor means, the directing means being movable in a downward direction; and a generally vertically disposed envelope chute having an upper end adjoining the forward end of the envelope receiver below the envelope directing means, said inclination of the envelope receiver and the juncture between the envelope receiver and the chute being effective to allow an envelope received in the envelope receiver as aforesaid to thereafter gravitate therefrom to against the envelope directing means and thence to be directed thereby into the envelope chute.

2. The depository of claim 1 wherein the envelope receiver and chute comprise an integrally molded member, the chute including spaced forward and rearward walls, the rearward wall of the chute curving upwardly and rearwardly to form a lower wall of the receiver.

3. The depository of claim 2 wherein the conveyor means includes conveyor belting for frictionally engaging one face of an envelope introduced into the envelope slot, power means for driving said belting in a direction effective to convey the envelope as aforesaid, and roller means disposed above said belting effective to engage the other face of an envelope introduced into the envelope slot as aforesaid, the roller means being movable in upward and downward directions with respect to said belting in order to accommodate envelopes of varying thickness.

4. The depository of claim 3 wherein a portion of said conveyor belting is disposed below said rearward end of the conveyor means and constitutes said envelope directing means.

5. The depository of claim 4 wherein the roller means are gravitationally biased in a downward direction, whereby the roller means floatingly engage said other envelope face.

6. The depository of claim 5 including power actuated envelope printing means disposed below said belting effective to selectively print indicia on said one face of an envelope during conveyance of same by the conveyor means as aforesaid.

* * * * *